US008499514B2

(12) United States Patent
Farrell, Jr. et al.

(10) Patent No.: US 8,499,514 B2
(45) Date of Patent: Aug. 6, 2013

(54) WIRE MESH SCREED

(75) Inventors: William J. Farrell, Jr., Anniston, AL (US); John M. Metrock, Montevallo, AL (US)

(73) Assignee: Met-Rock, LLC, Anniston, AL (US)

( * ) Notice: Subject to any disclaimer, the term of this patent is extended or adjusted under 35 U.S.C. 154(b) by 2113 days.

(21) Appl. No.: 10/696,583

(22) Filed: Oct. 30, 2003

(65) Prior Publication Data

US 2004/0134158 A1 Jul. 15, 2004

Related U.S. Application Data

(60) Provisional application No. 60/422,089, filed on Oct. 30, 2002.

(51) Int. Cl.
*E04B 2/00* (2006.01)

(52) U.S. Cl.
USPC ..... 52/371; 52/676; 52/791.1

(58) Field of Classification Search
USPC ..... 52/664, 791.1, 364, 366, 376, 388, 52/660, 676, 371, 375, 426, 384, 385, 386, 52/405.1; 404/118
See application file for complete search history.

(56) References Cited

U.S. PATENT DOCUMENTS

| | | | | | |
|---|---|---|---|---|---|
| 290,133 | A * | 12/1883 | Stanley | 52/660 |
| 1,664,837 | A * | 4/1928 | Strand | 52/454 |
| 1,932,276 | A | 10/1933 | Kublanow | |
| 2,669,114 | A * | 2/1954 | Mills | 52/454 |
| 3,407,560 | A * | 10/1968 | Baumann | 52/645 |
| 4,104,842 | A * | 8/1978 | Rockstead et al. | 52/649.1 |
| 4,611,450 | A * | 9/1986 | Chen | 52/309.4 |
| 4,660,342 | A * | 4/1987 | Salisbury | 52/358 |
| 5,540,023 | A | 7/1996 | Jaenson | |
| 6,272,805 | B1 * | 8/2001 | Ritter et al. | 52/309.11 |
| 6,430,824 | B1 | 8/2002 | Smith | |
| 6,718,712 | B1 | 4/2004 | Heath | |
| 6,820,387 | B2 * | 11/2004 | Sacks et al. | 52/660 |

* cited by examiner

*Primary Examiner* — William Gilbert
(74) *Attorney, Agent, or Firm* — Cahn & Samuels, LLP

(57) ABSTRACT

This invention relates to screed methods and building panels. According to the invention there is provided a construction panel comprising two outer wire mesh members and a middle member secured therebetween. The wire mesh members may have a plurality of V-shaped impressions along their length which serve as a built in visual and mechanical screed for finishing the panel with shotcrete or plaster. Alternatively, the wire mesh members may have a clipped-on-screed member attached thereto which serves as a visual and mechanical screed for finishing the panel. The middle member may comprises a composite of alternating layers of wire trusses and polystyrene foam. The middle member may be secured in a compressed state and released after attachment to the wire mesh members.

14 Claims, 11 Drawing Sheets

FIG. 6
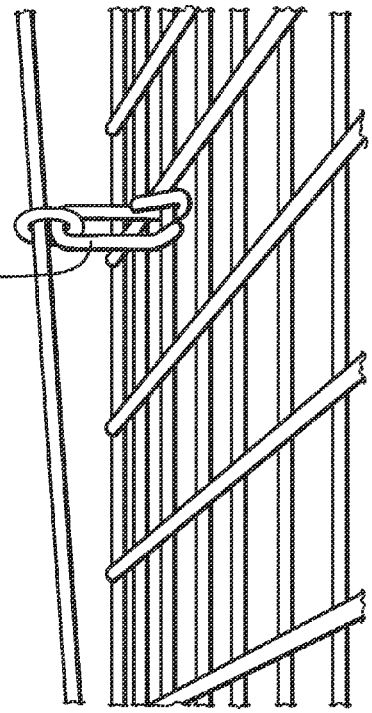
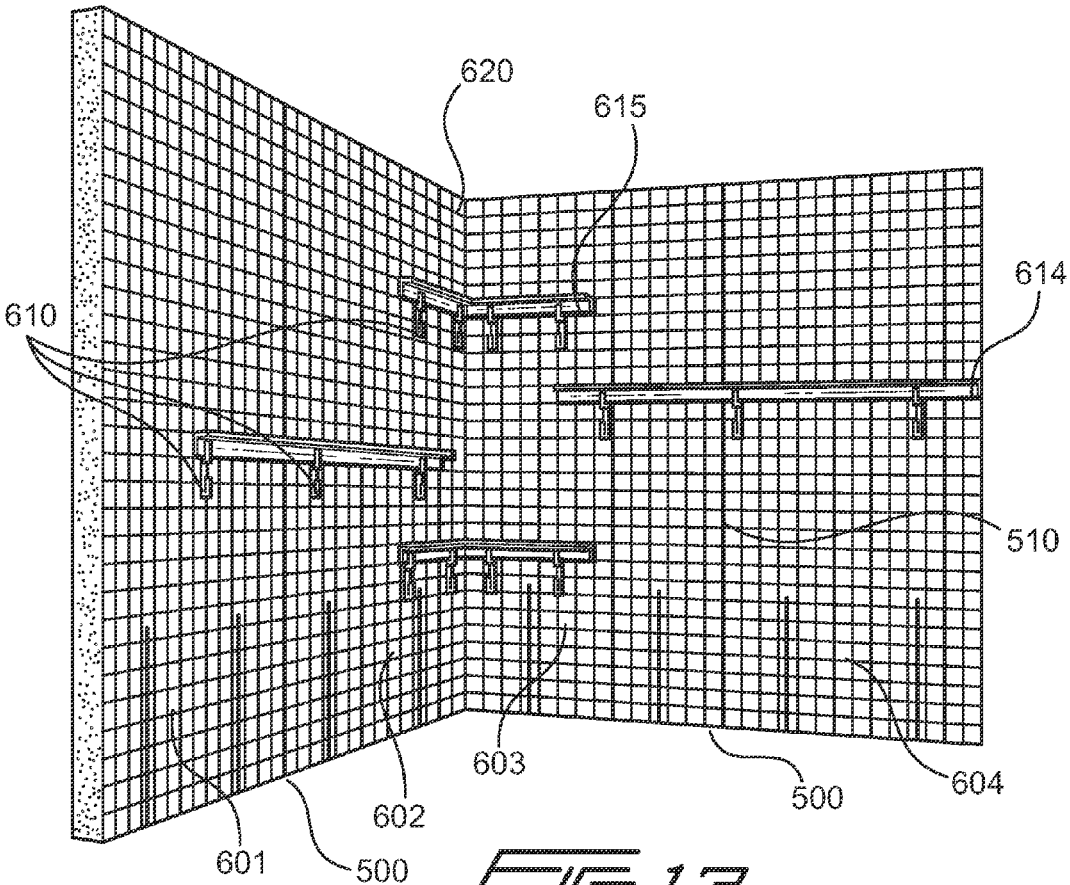
FIG. 13

WIRE MESH SCREED

This application claims the benefit of priority under 35 U.S.C. 119(e) from U.S. Ser. No. 60/422,089 filed on Oct. 30, 2002.

I. FIELD OF THE INVENTION

This invention relates to construction materials. More particularly, this invention relates to panel screeds, screed panel systems and novel methods of construction panels for use in construction.

II. BACKGROUND OF THE INVENTION

Screed systems are known in the art. For example, in a traditional method of plastering a wall product, ceiling, or floor, without the placing of tiles on the wall product thereafter, wooden float strips are used to guide a straight edge across an area forming the wall product being plastered, while raking off excess mud, etc. left in the application of the mud. The float strips, or "screeds" are tapped into the prepared or wet mud, such as mortar, cement, or other suitable materials, with a separate level held against one or more of them to obtain a horizontal, vertical, or other orientation or plum. The float strips, straight edge, and the board carrying the mud itself, are usually wet before use so that they will not draw moisture out of the prepared mud. It is plumbed as much as possible, for the purpose of keeping the finished wall product or ceiling surfaces as straight as possible, however, a true planar wall surface is not generated with the traditional tools, and much is left up to the individual craftsman or novice.

As will be appreciated, the difficulties with prior art screed systems are particularly acute with respect to preparing walls, such as foundation walls for buildings. In many prior art techniques, a craftsman looking to plaster a wall would have to prepare initial mud columns by hand on the wall. These columns would be erected for accepting a screed which would be used to allow the wall to be filled and cut to a uniform depth. However, mud columns crafted by hand were never truly uniform and difficult and time consuming to construct. Other artisans have tried to overcome these difficulties by fabricating pre-formed screeds for attachment to building materials, thereby by-passing the need for hand made screed columns. However, these prior art methods still suffered from the drawbacks that they were labor intensive and had to be preformed on site. For example, the screeds could not be put into place until the building materials were in place and ready for finishing.

The foregoing underscores some of the problems associated with conventional building and finishing techniques and devices. Furthermore, the foregoing highlights the long-felt, yet unresolved need in the art for a screed system which allows for building materials, such as walls or wall panels or roof or floor panels, to be prefabricated and prepared for immediate finishing.

III. SUMMARY OF THE INVENTION

The present invention overcomes the practical problems described above and offers new advantages as well. One object of the invention is to provide a building panel ready for attachment and finishing. According to this object of the invention, one aspect of the invention is to provide a construction panel comprising a pair of wire mesh outer members and a middle member.

An advantage of the invention lies in that the wire mesh members may be configured to include a plurality of V-shaped impressions which will serve as a visual and mechanical built-in screed.

Another advantage of the invention lies in that a screed member or members may be attached to one or both wire mesh members to serve as a visual and mechanical built-in screed.

According to another aspect of the invention, the wire mesh members may be secured to the middle member, or alternatively to each other, such that a gap for receiving rebar or other support materials is left for ease of attachment to a foundation prior to finishing. An advantageous feature according to this aspect of the invention is that the wire mesh members may be welded or clipped with hog rings to the trusses to secure the middle member.

According to another object of the invention, the middle member comprises a sandwich of wire trusses and polystyrene materials. In accordance with this object of the invention, the wire trusses and polystyrene materials are compressed by compression means, such as a jig, and secured in the compressed state by clamping means until after the wire mesh members are attached. After attachment the clamping means is removed allowing the middle member to expand and exert a force on the wire mesh members.

Another object of the invention is to provide methods of making the aforementioned construction panels and methods for finishing the aforementioned panels.

Another object of the invention is to provide novel methods of installing the aforementioned construction panels and joining the panels to other panels or other construction components.

The invention as described and claimed herein should become evident to a person of ordinary skill in the art given the following enabling description and drawings. The aspects and features of the invention believed to be novel and other elements characteristic of the invention are set forth with particularity in the appended claims. The drawings are for illustration purposes only and are not drawn to scale unless otherwise indicated. The drawings are not intended to limit the scope of the invention. The following enabling disclosure is directed to one of ordinary skill in the art and presupposes that those aspects of the invention within the ability of the ordinarily skilled artisan are understood and appreciated.

IV. BRIEF DESCRIPTION OF THE DRAWINGS

The present invention is described with reference to the accompanying drawings. In the drawings, like reference numbers indicate identical or functionally similar elements.

FIG. 6 is a picture of a clipped-on-screed according to another embodiment of the invention.

FIG. 13 is a photograph of panel members joined in a corner assembly according to the invention.

While the invention will be described and disclosed in connection with certain preferred embodiments and procedures, it is not intended to limit the invention to those specific embodiments and procedures. Rather it is intended to cover all such alternative embodiments and modifications as fall within the spirit and scope of the invention.

V. DETAILED DESCRIPTION OF THE DRAWINGS

Generally, the present invention relates to novel screed devices and methods, and in particular the use of built-in or integral screeds. The present invention also relates to novel methods, techniques and equipment for erecting and joining novel prefabricated panels for various uses in the construction industry. While the present invention is described in connection with a construction panel having a built-in screed or a clipped-on screed, it will be readily appreciated by one of ordinary skill in the art that the teachings of the present invention can be applied to a variety of construction needs in a variety of fields. In addition, while the present invention will be described in connection with erecting and joining prefabricated panels constructed according to the teaching herein, one of ordinary skill in the art will appreciate that the novel tools and methods described herein can be applied to a variety of construction needs in a variety of fields. For example, the panels of the present invention could be used in form and pour applications, such as setting up steel forms for a basement wall then dropping the panels inside the steel form.

Figure 1:
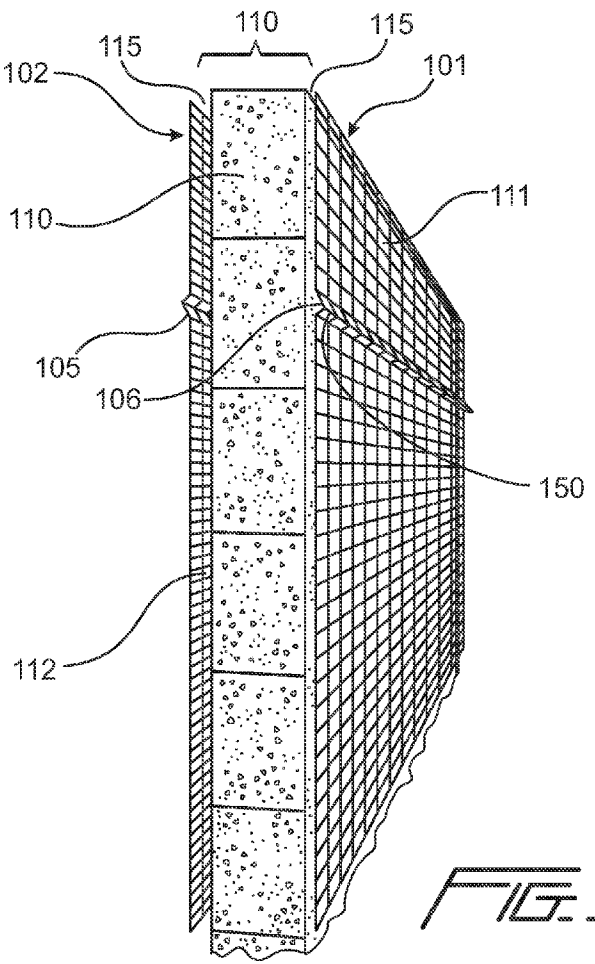
FIG. 1 is a picture of a basic panel member according to one embodiment of the invention.

A preferred embodiment of the invention is a construction panel for building a load bearing wall of a building. In its simplest form, as depicted in FIG. 1, construction panel 10 according to the invention comprises first and second wire mesh members 101, 102 and a middle member 110 disposed therebetween. The wire mesh members 101, 102 and the middle member 110 define a small gap 115 between the front 111 and back face 112 of middle member 110 and the wire mesh members 101, 102. The coupling of the wire mesh members 101, 102 to the middle member 110 is described below, as is the significance of small gap 115.

Figure 2:
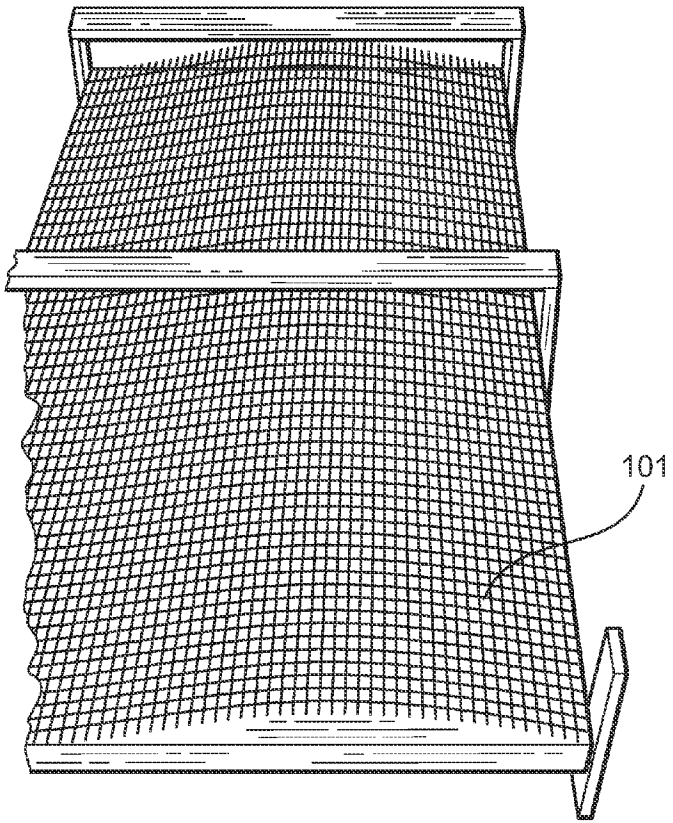
FIG. 2 is a picture of a piece of wire mesh for use in accordance with the some embodiments of the present invention.

According to the invention, wire mesh members 101, 102 can be of any suitable wire mesh or like material. Typically, wire mesh is manufactured as a grid of vertical and horizontal welded wire strands. FIG. 2 depicts a presently preferred wire mesh material 101 for use in the present invention. As depicted in FIG. 2, wire mesh comprises a 4 foot by 8 foot piece of 1"×1" wire mesh. Preferably, the wire mesh comprises 14-gauge galvanized wire mesh. More preferably, the wire mesh comprises a 14-gauge galvanized 1"×1" wire mesh with a welded 9-gauge wire as the lead wire to each screed as described in more detail below. Alternatively, the wire mesh comprises 9 gauge galvanized wire.

Figure 3:
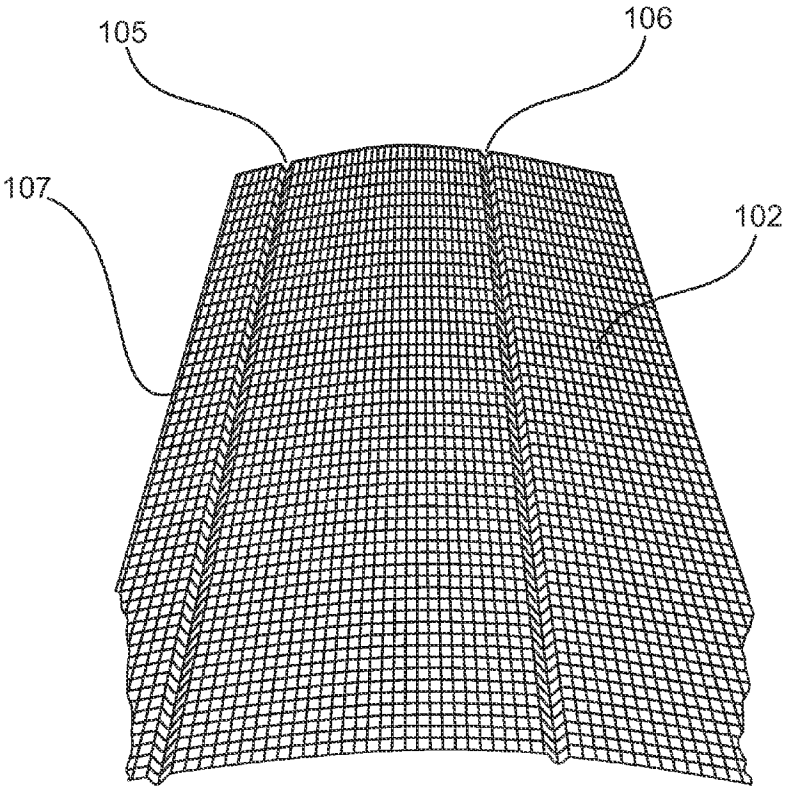
FIG. 3 is a picture of a modified piece of wire mesh for use in accordance with some embodiments of the present invention.

According to one embodiment, as depicted in FIG. 3, wire mesh 102 is provided with two parallel V-shaped impressions 105, 106 along its length. Preferably, the impressions on a 48-inch wide piece of wire mesh will be spaced 30 inches apart from center, or 9 inches away from the leading edge of the panel. More preferably, the wire mesh will have two strands of 9 gauge wire (not shown) as the leading (apex) wires where the impressions are to be made. Also preferably, at least the leading wire, whether 9 gauge or not, will be coated with zinc to prevent rusting.

According to this embodiment, a 48-inch wide piece of wire mesh 102 is supplied with two ½ inch V-shaped impressions 105, 106 about 30 inches apart on center. Notably, after receiving the impressions, the wire mesh is reduced in width to approximately 47.25 inches.

Neither the distance between the impressions nor the number of impressions is critical to the invention and all such variations should be deemed to be within the scope of the invention. However, it is preferred in this embodiment to provide two impressions at no more than 40 inches apart.

Figure 7:
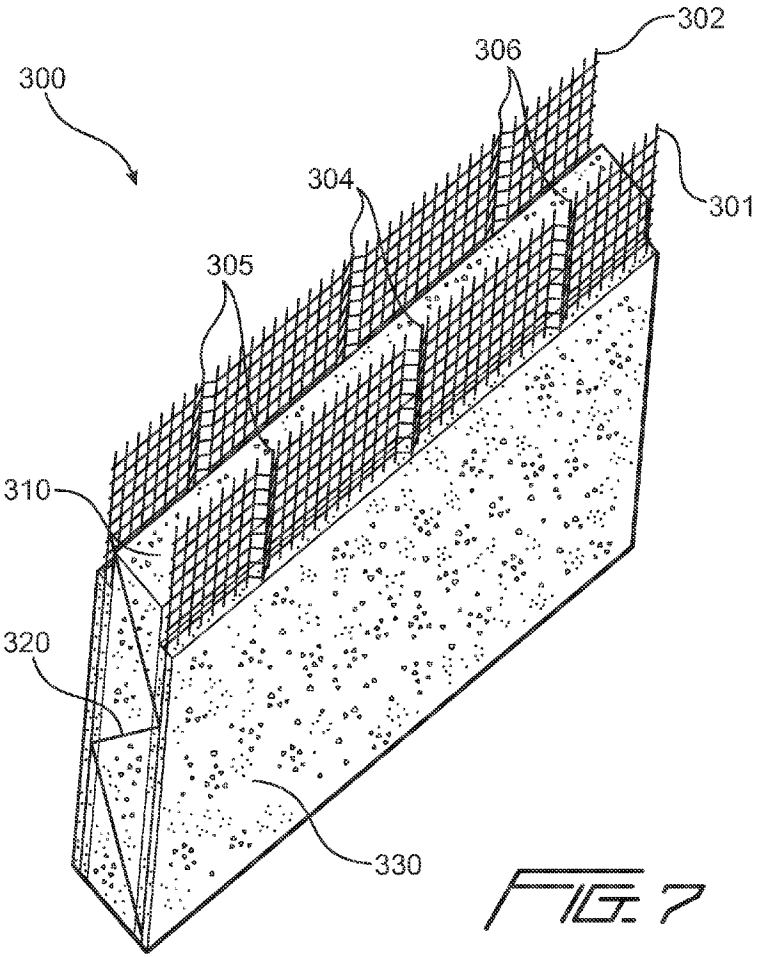
FIG. 7 is an isometric view of a preferred embodiment of a finished panel member according to the invention.

In a presently preferred embodiment of the invention depicted in FIG. 7, the construction panel 300, which the inventors refer to as the "Met-Rock Panel," includes three impressions in 48-inch mesh members 301, 302. A first impression, or middle impression 304, is centered at approximately 24 inches, and two other impressions, or left and right impressions 305, 306, are positioned approximately 8 inches from their respective edges of the panel. One advantageous feature of this configuration, which will be elaborated on herein, is that once two or more panels are joined end to end, there will be an impression approximately every 16 inches. According to this embodiment, it is preferable that at least the leading wires 304, 305, 306, if not the whole mesh, comprises 9-gauge galvanized wire. Alternatively, in a presently preferred embodiment, the wire mesh members 301, 302 comprise 1"×1" 14-gauge mill galvanized welded wire mesh with 9-gauge galvanized lead wires 304, 305, 306. One of ordinary skill in the art will appreciate that the materials of construction may be varied to take advantage of certain properties or to fit an intended use.

Additionally, as will be appreciated, the exact configuration and depth of the impressions is not critical and can be varied according the skill of one in the art to suit the intended purpose of the panel and the depth of finishing materials to be applied. Presently preferred depths for the impressions are about one half of the depth of the finishing material that is to be applied to the wire mesh or panel.

Turning back to FIG. 1, once the impressions 105, 106 are suitably made wire mesh members 101, 102 are ready for mounting to middle member 110. Middle member 110 may comprise any suitable material for the intended use of the panel 10. In a presently preferred embodiment, middle member 110 comprises a sandwich composite of wire trusses and polystyrene foam material. In a particularly preferred embodiment, middle member 110 comprises a sandwich of nine wire trusses and eight pieces of polystyrene. The middle member composite will be compressed prior to being secured between the wire mesh members, although any suitable means for compressing the composite may be utilized, the present inventors have devised a novel methods and tools for compressing the composite.

Figure 20:
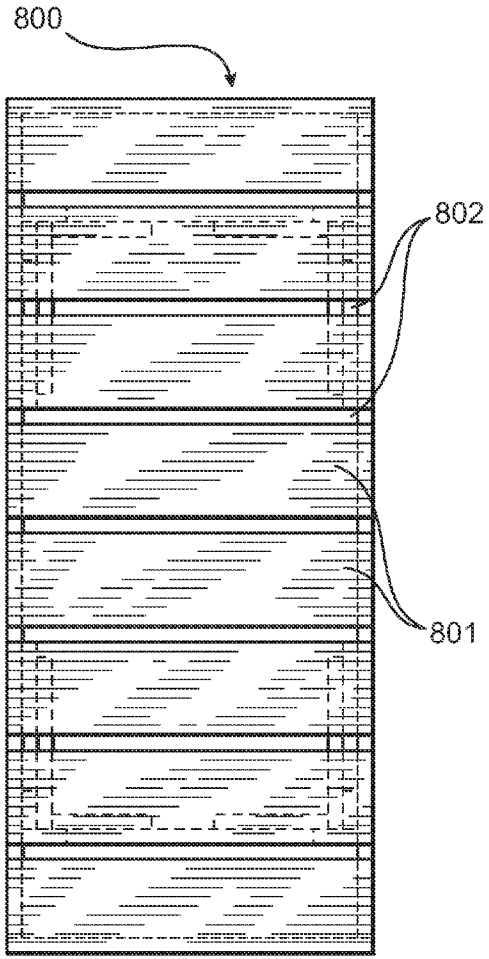
FIG. 20 is a top view of the jig table of FIG. 19.
Figure 19:
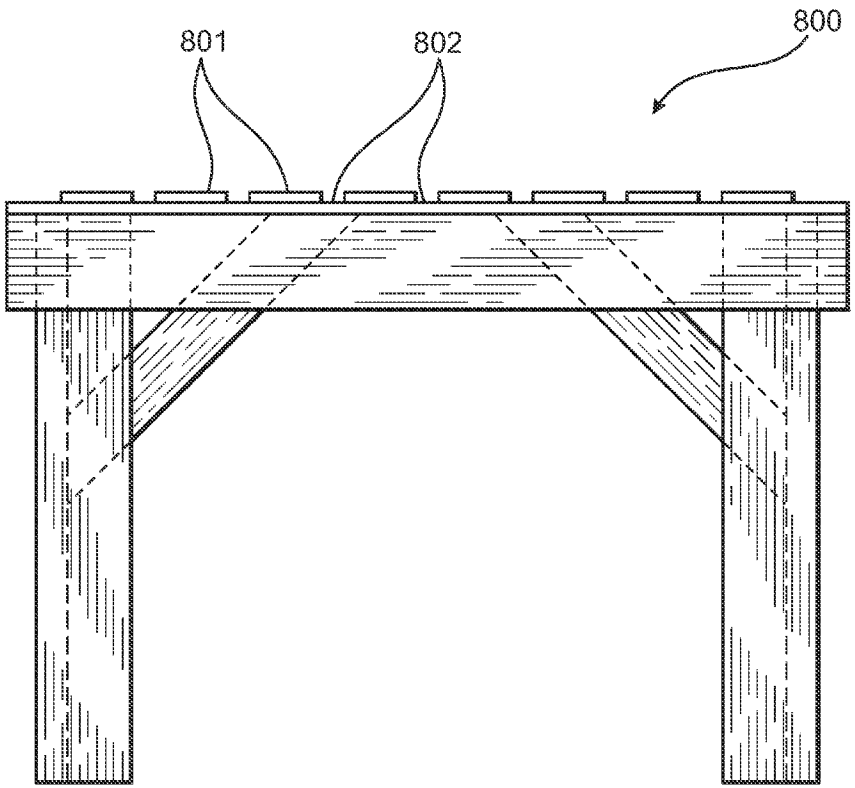
FIG. 19 is a front view of a jig table according to the invention.

As depicted in FIGS. 19 and 20, a jig table 800 is provided with eight (8) risers 801. Jig table 800 also includes nine (9) slots 802 disposed between (or on each side of) the risers to provide a gap between the risers 801. According to a presently preferred embodiment, the slots offer a 1" gap between the risers 801. The composite is positioned such that the wire trusses are dropped into each slot 802 and the polystyrene foam is positioned on top of each riser 801. Once the composite is in place, a jig press is positioned over the table and appropriately secured before the assembly process. The jig press is then manipulated to compress the composite up to 2.5 inches. According to a presently preferred embodiment, the risers are ½" high to ensure that gap 115 between the wire mesh members 101, 102, and 301, 302 and the middle member 110 and 310 is approximately ½ inch. However, as will be appreciated in view of the teachings herein, if an increased thickness of finishing material, such as shotcrete or plaster, is desired on the sides of the panel the height of the risers 801 can be increased to the preferred size of gap 115. Changing the height of risers 801 will change the distance from the outer faces of the foam of the composite middle member 110 and 310 to the inside edge of the back face of the wire mesh members 101, 102, and 301, 302. However, the V-shaped notches will ensure that although the wire mesh members are no longer disposed in the middle of the finishing material, they remain ½" from the outer edge of the finished panel.

The compressed composite is held in the compressed state by clamps or other means of securing the composite from expansion. Once secured in the compressed state, the composite is ready for mounting of the wire mesh members 101, 102 and 301, 302. In preferred embodiment, the jig containing the composite is rotated from the horizontal to the vertical position to ease the securing of the wire mesh members 101, 102, or alternatively, and more preferably, the jig can be rotated 180 degrees completely to the horizontal.

Figure 4:
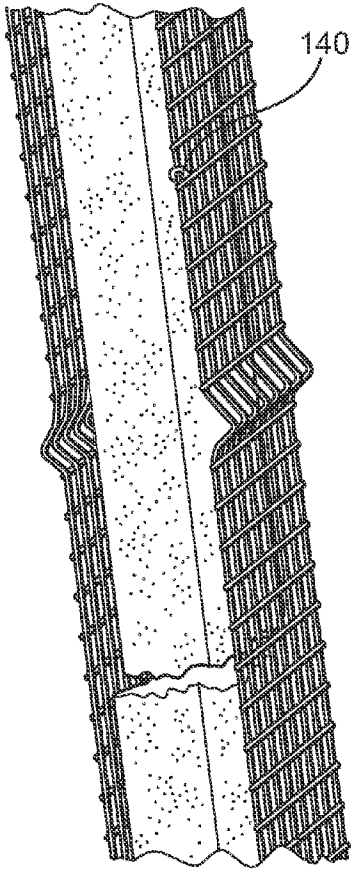
FIG. 4 is a picture of a side view of a panel member according to one embodiment of the invention.

The wire mesh members 101, 102 may be secured by any suitable means. According to one embodiment of the invention depicted in FIG. 4, the wire mesh members are secured to sandwich middle member 110 by the use of hog rings attached to wire trusses on the panel ends. This means of securing the wire mesh members around the middle member is particularly preferred for panels using 1"×1" wire mesh.

Figure 5:
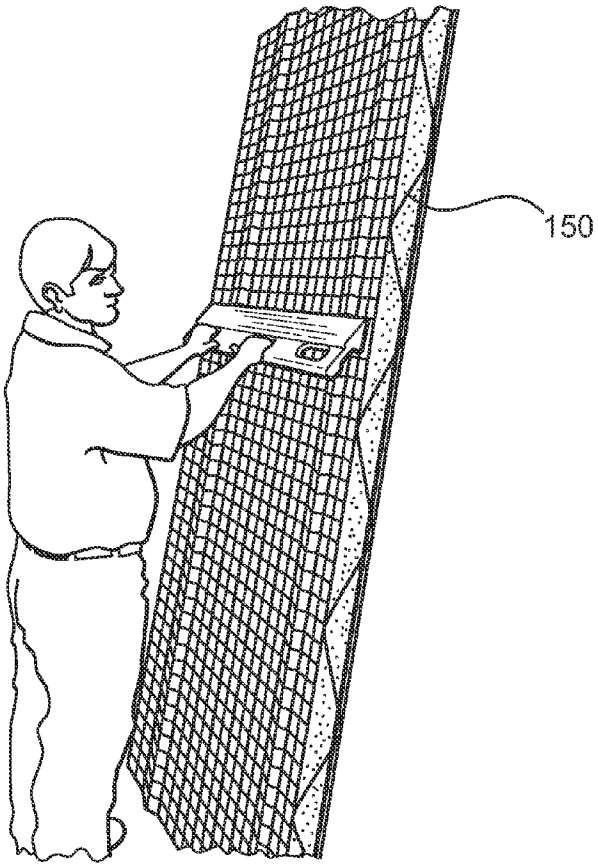
FIG. 5 is a picture of a panel member and a screed blade for use according to one aspect of the invention.

In an alternative embodiment of the invention depicted in FIG. 5, the wire mesh members are welded to the trusses. This means of securing the wire mesh members and the middle member is particularly preferred for panels using 2"×2" mesh.

As will be appreciated by one of ordinary skill in the art, numerous methods of securing the wire mesh are possible. All suitable methods should be view as within the scope of the invention, as well as combinations of such methods. In a presently preferred embodiment, the truss comprises a zig-zag wire with an apex every 16 inches. The apexes are welded to a straight stay wire on both the top and bottom of the zig-zag wire. These truss wires are placed on the jig table and the foam placed between each truss, the trusses and the foam are compressed with the jig and secured in the compressed condition with clamps or other suitable means. Once compressed and secured, the wire mesh members are attached using hog rings to the stay wire (which is welded to the zig-zag wire) on the top, and then once the jig is rotated to 90 or 180 degrees, to the bottom stay wire.

After the wire mesh members 101, 102 are secured around the middle member 110, the composite is allowed to decompress. In other words, the clamp or means for holding the composite in the compressed state is removed. Quite unexpectedly, the present inventors have discovered that after decompression, a 48-inch panel which was reduced by the V-shaped compressions to 47.25 inches, expands back to the desired 48-inch width. In addition, advantageously, the panel remains tightly in tension.

After decompression, the panel composite 10 is ready for use. Panels may be assembled or attached to make a building, a wall, or any other suitable structure. For example, with buildings, the rebar extending from a concrete foundation or slab slides between the wire mesh and the middle member. The panel may then be wire tied. Other panels may likewise be placed on adjacent portions of the foundation and then connected to the previous panels. Panels may be connected by any suitable means. According to one embodiment, wire mesh is used to cover the panel seems by attaching the mesh with hog rings or any other suitable connector or connection means.

Once the building or other structure is erected, the panels are ready for finishing. Any suitable material may be used in finishing the panels, and will be dictated by the use and configuration of the panels. As will be appreciated in accordance with this embodiment, panels being used as wall will be finished with shotcrete or plaster. According to this embodiment, one inch of shotcrete or plaster is applied to the panel, and more preferably, to each side of the panel.

In view of the fact that there is a ½ inch gap 115, see FIG. 1, between each wire mesh members 101, 102 and the middle member 110, one inch of finishing material should result in the wire mesh being embedded about half way therein. In addition, given that the wire mesh was provided with two ½ inch deep V-shaped impressions 105, 106, the apex 150 of the impressions serves as a visual screed for the application of the finishing materials and then as a mechanical screed (allowing a 48-inch blade to be slid up and down the apexes of the impressions) to ensure the wall is cut flat and ready to be finished with, for example, a stucco look.

Notably, as will be appreciated by one of ordinary skill in the art, the wall can be erected with the impressions running horizontally (see FIG. 1) or vertically (see FIG. 5). In either case, the panel can be cut with a screed blade running along the apexes of the V-shaped impressions.

In an alternative embodiment, rather than provide impressions in the wire mesh, a screed member 200 is physically or mechanically clipped onto wire mesh members by any suitable means, such as that depicted in FIG. 6. The use of clipped-on-screed member is preferred for use with two in by two inch wire mesh. According to this embodiment, any suitable material may be used as middle member as previously described herein. In a preferred embodiment, when using two by two inch mesh, the wire mesh members are welded to middle member, more preferably, welded to wire trusses of middle member.

Clipped-on-screed member 200 may be constructed of any suitable material. In one embodiment, clipped-on-screed member comprises rigid wire, similar to that of the wire mesh members. Also, clipped-on-screed member can be configured to provide for any desired depth of finishing material, and can be attached to wire mesh members by any suitable means, such as wire tied or clipped. For large panels, it is preferred that multiple screed members be attached to the wall rather than attempting to use one long screed member to traverse the length of the panel.

Once the clipped-on-screed member or members are positioned in its desired position, the panel may be finished as previously described herein.

In operation, a preferred method of making a panel according to this embodiment of the invention comprises taking a stacking of 9-gauge wire truss, or more preferably, a 3/16" diameter wire truss, with a dimension of 5 inches wide by 8 feet long into a holding press. An approximately 4 inch thick by 6 inch wide by 8 feet long piece of polystyrene is placed parallel and alongside the wire truss, then another truss, then another piece of polystyrene, until the panel has reached a desired width for the building panel. In this embodiment, 9 pieces of wire truss and 8 pieces of polystyrene foam are used. Once all these materials have been stacked like a sandwich into the panel press, the press will compress this composite by up to 2.5 inches and hold it in a compressed state until the wire mesh members can be attached to each side of the panel using ½ inch hog rings. The preferred wire mesh members in this embodiment are 48-inch pieces of 1"×1" 14-gauge wire mesh with 9-gauge welded lead wires. The wire mesh members are physically bent to define two ½ inch V-shaped depressions (with the 9-gauge lead wires at their apex) along their length thereby diminishing the width of the members to approximately 47.25 inches.

After securing the hog rings, the panel is taken out from under the compression of the press and allowed to expand. Although not wishing to be bound by theory, it is believed that the expansion of the polystyrene causes the width of the panel of this embodiment to recover from the approximately 47.25 inch width of the wire mesh back, at least approximately, to the desired 48-inch width which is needed for the building under construction. In addition, although not wishing to be bound by theory, it is believed that the tension of the panel resulting from the impression screeds being formed on the wire mesh causes the panel to remain unexpectedly secure and to not lose its shape or dimension, even though the wire mesh is secured to the truss by only about 16 hog rings to 72 hog rings, in other words, without welding.

FIGS. 7-18 depict various aspects of a presently preferred embodiment of the invention the inventors refer to as the Met-Rock Panel. As previously mentioned, and as depicted in FIG. 7, the construction panel 300 includes first and second wire mesh members 301 and 302 disposed on opposite sides a middle member 310. Trusses 320 are used on each end of the panel to ensure the sandwich composite of the wire mesh members 301, 302 and middle member 310 are secured in their proper orientation. FIG. 7 also shows a 1 3/16-inch layer of concrete 330 as a finishing material applied to both sides of the panel and smoothed using the three built in screed notches 304, 305, and 306.

Although any suitable materials and any suitable configurations are contemplated by the present invention, in a presently preferred embodiment, the wire mesh members comprise a 4 foot (48 inches) by 8 foot sheet of 1 inch by 1 inch 14-gauge wire mesh. Alternatively, and as depicted in some of the Figures, the material may be a 12-inch wide 14 gauge 1"×1" galvanized wire mesh. Preferably, the wire mesh members 301, 302 will have ½-inch pressed-in screeds 304, 305, 306 with welded 9 gauge galvanized leading wire. A central screed 304 is disposed on center and a left and right screed 305, 306 are disposed 16 inches of center in their respective directions. This configuration provides for screeds every 16 inches once two or more panels are joined end to end.

Middle member 310 may comprise any suitable material for the construction project undertaken. In a presently preferred embodiment of a support wall, the middle member 310 comprises readily available 2"×6", 4"×6", or 6"×6" polystyrene blocks.

Figure 9B:
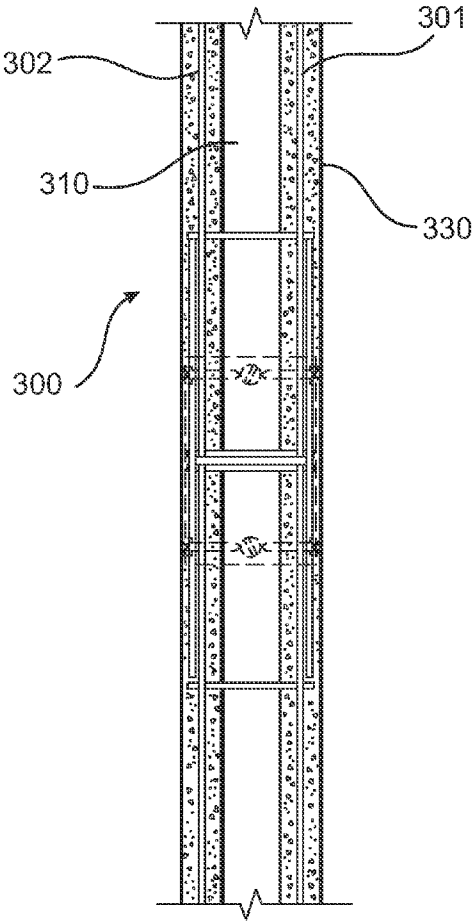
FIGS. 9A and 9B are cross-sectional side views of two different width finished panel members according to the invention.
Figure 9A:
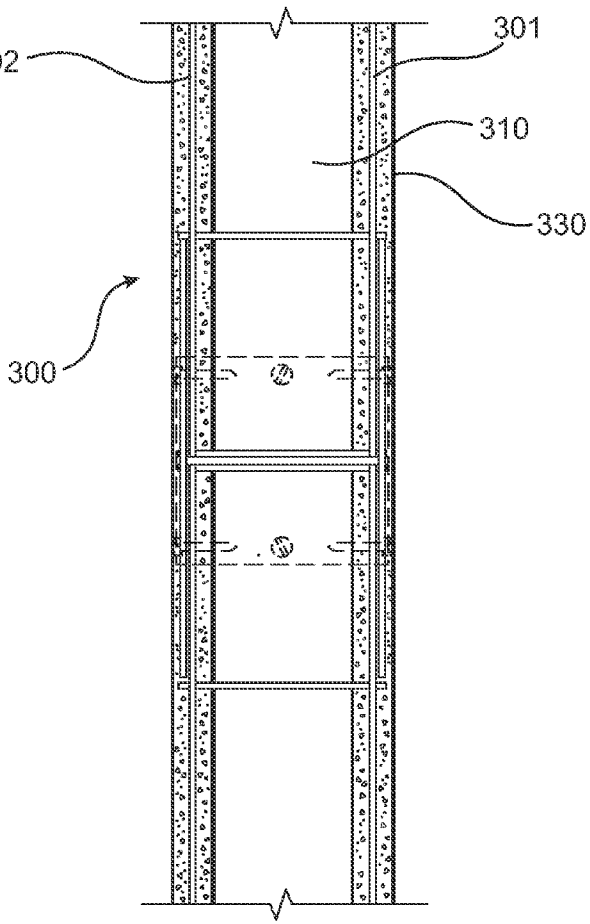

FIG. 9A depicts a cross sectional view of a six inch (actually 6⅜") wall connection using 4"×6" blocks of polystyrene foam insulation. FIG. 9B depicts a cross sectional view of a 4 inch wall connection using 2" polystyrene foam insulation.

Figure 8:
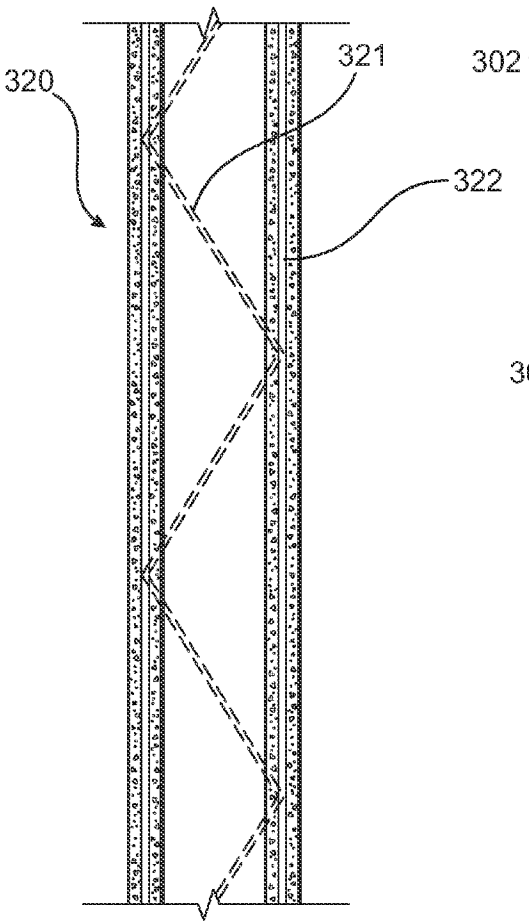
FIG. 8 is a side view of a preferred embodiment of a finished panel member according to the invention.

Wire trusses 320 may be of any suitable configuration and secured by any suitable means. In a presently preferred embodiment, the trusses comprises 3-inch, 5-inch or 7-inch welded galvanized truss attached using 11 gauge galvanized hog rings disposed every foot to 1"×1" 14 gauge mill galvanized welded end wires of wire mesh members 301, 302 having built-in depth screeds. As depicted in FIG. 8, presently preferred is a steel truss fabrication comprising a 3/16" gauge truss web 321 factory welded to a 3/16" wire cord 322 which is factory welded to each strut and grid. The truss may utilize a typical truss gauge of 73/16".

Figure 10:
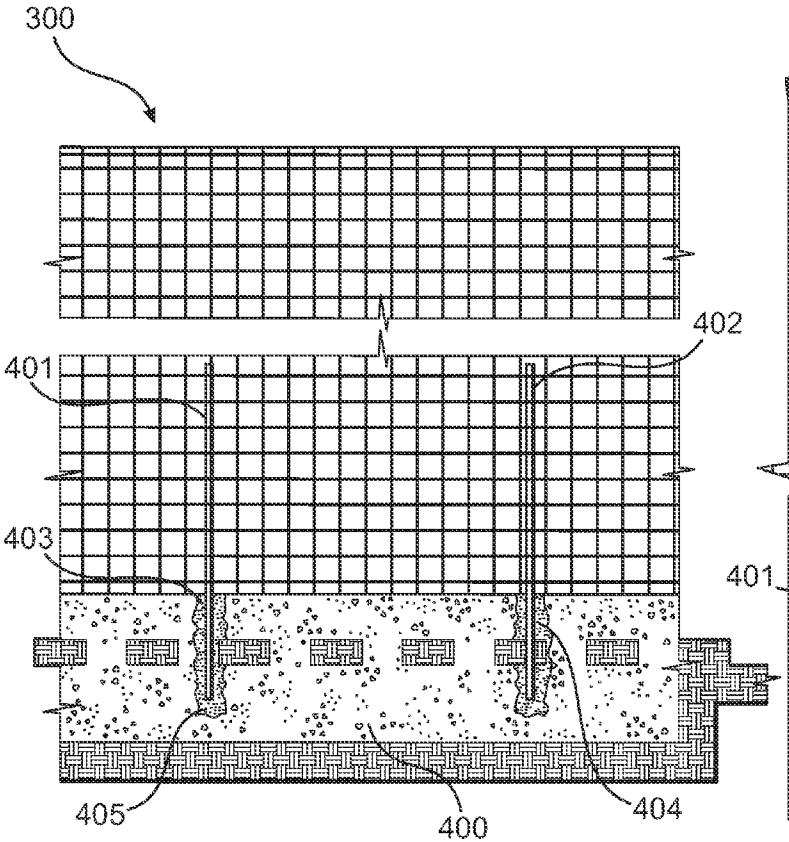
FIG. 10 is a partial cross-sectional view of a panel member erected on a foundation or slab for use in a wall or corner assembly according to an embodiment of the invention.

FIG. 10 is a depiction of a panel 300 erected as a support wall. According to a preferred method of installing a 4-inch panel, two parallel chalk lines (not shown) spaced 4¼ inches apart are made on the foundation or slab 400 where the panel is to be erected. These chalk lines are used to align 24" re-bar dowels 401, 402 every two feet. Preferably, the dowels 401, 402 are positioned such that the panel 300 will align with the first dowel 401 one-foot to the left of the centerline of the panel and align with the second dowel 402 one-foot to the right of the centerline of the panel.

Dowels 410, 402 are used to anchor panel 300 to the foundation or slab 400. A pair of 6¾ inch deep holes 403, 404 are drilled into the foundation or slab 400 for receiving dowels 401, 402. Dowels 401, 402 are preferably anchored into the concrete with grout or epoxy 405. Notably, although not shown, there is preferably a matching pair of dowels, or corresponding dowels, disposed and anchored on the other side of the panel 300. The four dowels preferably ascend about 18 inches vertically from the slab 400.

The panel 300 is positioned vertically so that the dowels can slide into the ½ inch space (not shown) between the backside of the wire mesh member and the leading edge of the expanded polystyrene foam insulation. Preferably, about ½ inch of the foam is melted or removed from the back side of each dowel so that 1½ inch of shotcrete, plaster, or other suitable material can encapsulate each dowel. The dowels are then connected to the wire mesh 301 using wire ties (not shown), preferably two ties per dowel. However, any suitable securing means may be used. Once secured, the panel may be finished according to the methods previously discussed.

Figure 11:
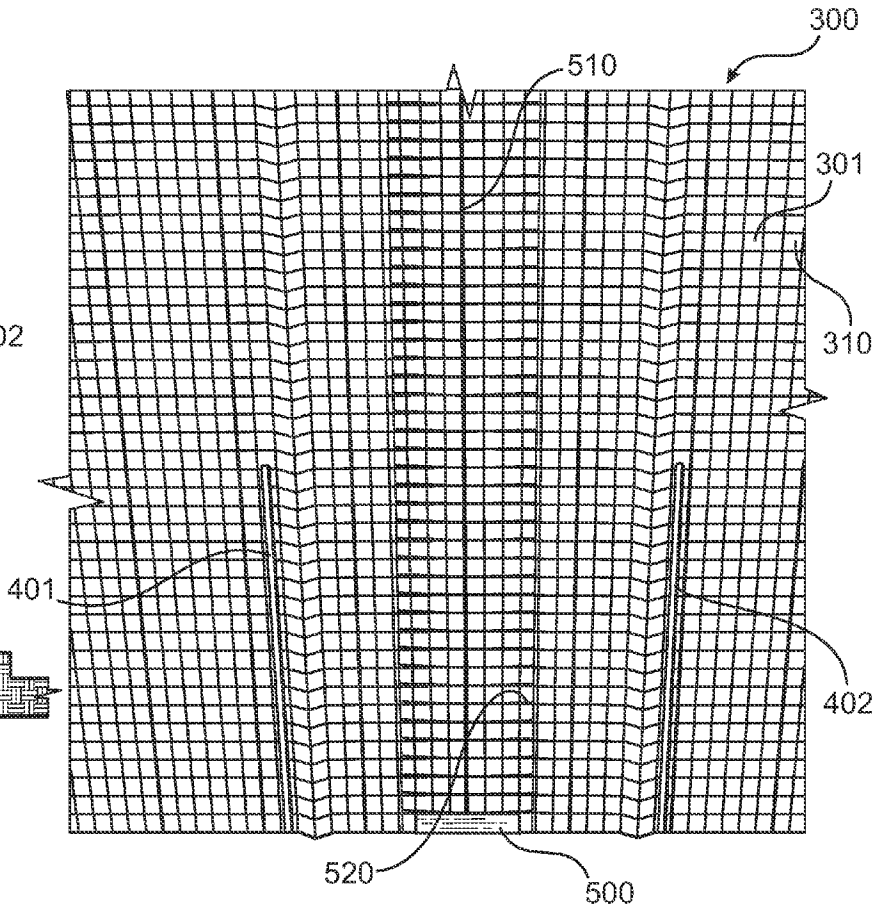
FIG. 11 is a photograph of the bottom of two panel members joined for use in a wall or corner assembly according to the invention.
Figure 12:
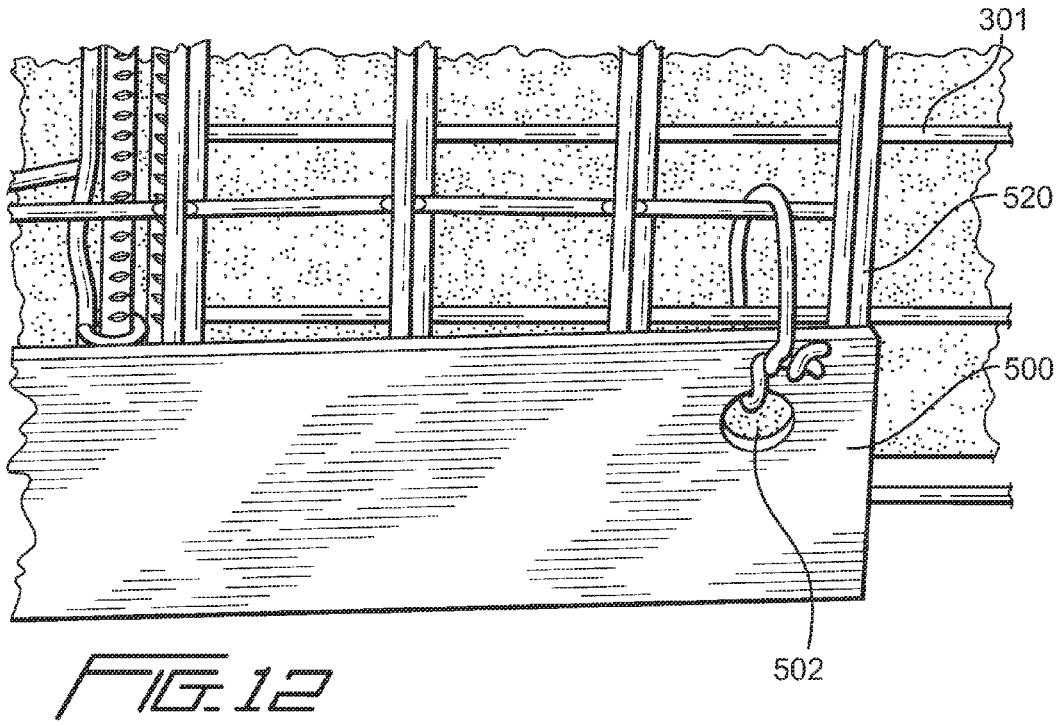
FIG. 12 is a close-up photograph of the metal clip depicted in FIG. 11 for joining two panel members according to the invention.

The lateral mating of two panels is depicted in FIGS. 11 and 12. Although any suitable means for securing panels at the seams may be used, in a presently preferred embodiment, if two or more panels are going to be connected laterally, the present inventors have developed a novel metal clip to use for this purpose. As shown in FIG. 11, after the chalk lines are laid, in addition to providing dowels 401, 402 every 24 inches, a metal clip 500 is secured to the slab 400 using a pair of ¼" diameter screws (not shown) wherever two panels 300 will meet to form a seam 510.

As best discerned from FIG. 12, the presently preferred clip 500, which the inventors refer to as the "Met-Rock Metal Clip," is a 6" long and 5 3/16" wide 22 gauge galvanized metal clip with a 1½ inch metal flange 501 on each side of the clip 500. Obviously, the width of the clip will vary based on the size of wire trusses used to manufacture the panel 300. For example, the metal clip for a 3" truss will have an inside diameter of 3 3/16". Holes 502, preferably 3/8" in diameter, are drilled on each end of the clip on preferably, both the front 503 and back of the clip 500.

When two panels are two be erected and joined at a seam 510, it is presently preferred that a 12-inch lap of mesh be disposed on each panel at the seam using hog rings (not shown). Alternatively, as depicted in FIG. 11 a 6-inch lap 520 may be used, although a 12-inch lap is presently preferred.

As shown in FIG. 12, once the panels are positioned over the dowels and into the clip, wire tie 505 is inserted through the left front hole 502 of clip 500 for securing the wire mesh 301 of the right panel and the lap 520 of the left panel to the clip 500. Likewise, although not shown, the other three holes in the clip are disposed to allow a wire tie to secure a portion of the wire mesh of a panel and a portion of the lap of the adjacent panel to the clip.

The inventors have also developed novel methods and tools for securing construction panels in alignment until for finishing with, for example, shotcrete or plaster. These novel methods and tools are particularly useful when assembling panels in a corner or perpendicular configuration. FIGS. 13-15 depict four panels 601, 602, 603, and 604. Panels 601 and 602 and panels 603 and 604 have been laterally mated according to the methods described above including the use of metal clip 500. At this juncture, panels 602 and 603 form a corner 620 which must be kept square for the application and hardening of a shotcrete, or other finishing material, application on the outside of the panels.

Figure 14A:
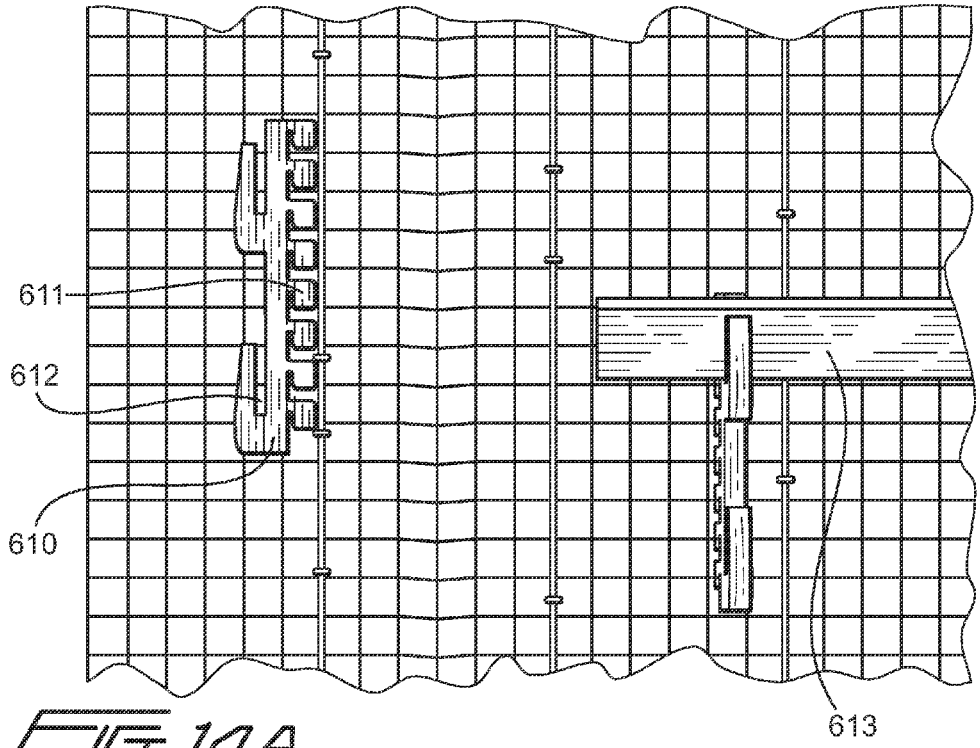
FIGS. 14A and 14B are photographs of a plastic clip for use in the plastic clip-angle iron assembly for aligning panels according to the invention.
Figure 14B:
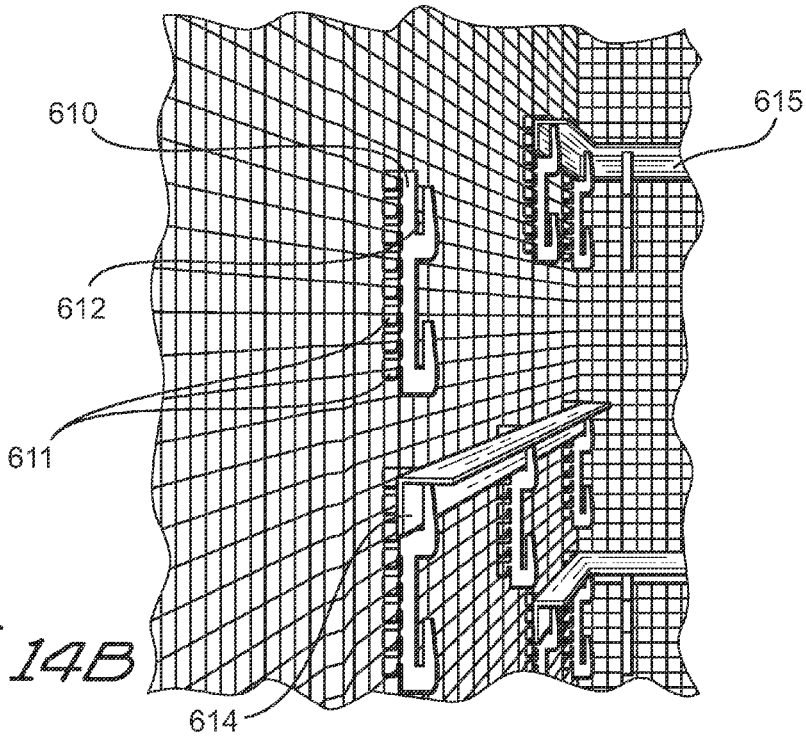
Figure 15B:
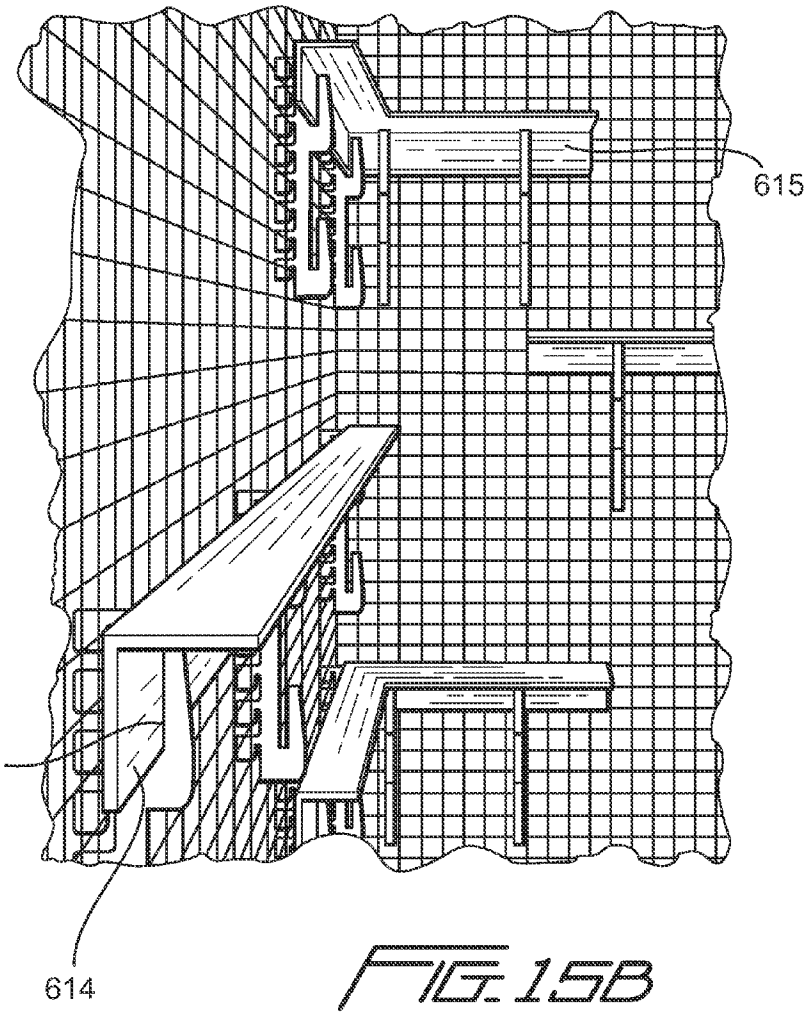
FIGS. 15A and 15B are photographs of a corner assembly using the plastic clip-iron angle assembly according to the invention.
Figure 15A:
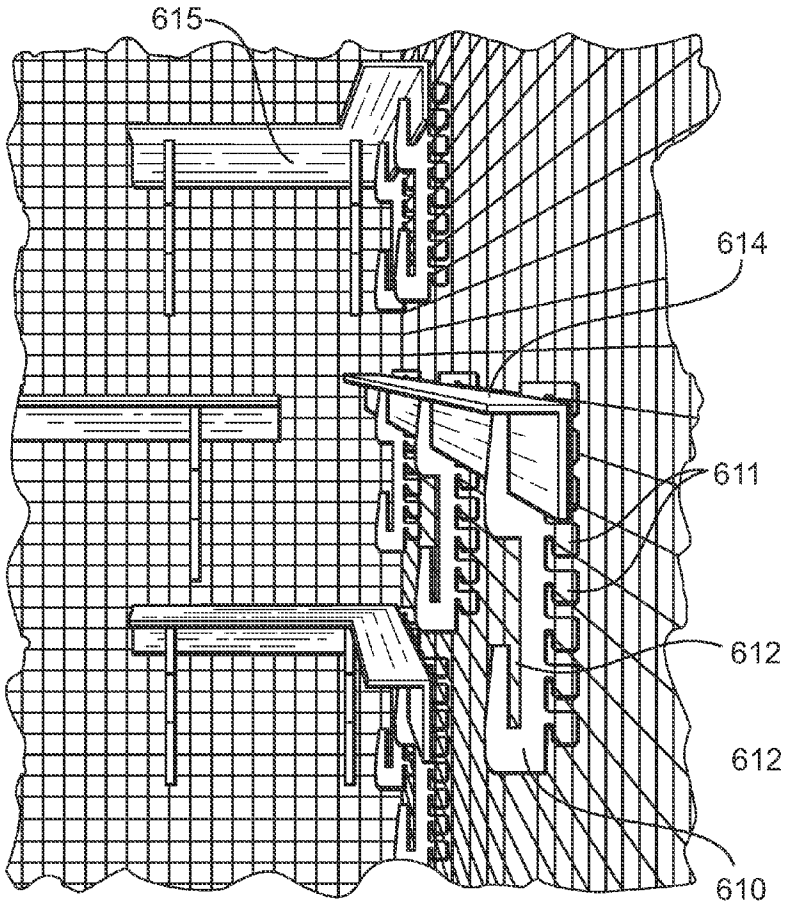

As best shown in FIGS. 14A and 14B, temporary clips 610, preferably made of plastic, have a plurality of hooking members 611 on one side and at least one slot 612 on the other side are snapped into wire mesh 301. The hooking members 611 are spaced apart and configured to be removably couplable to the wire mesh. The slot(s) 612 is configured to receive at least on rigid member 613. Preferably, rigid member 613 comprises an angle iron. In operation, the plastic clips 610, which the inventors refer to as the "Temporary Met-Rock Panel Plastic clips," are horizontally aligned and snapped into the wire mesh approximately every 36" off-center. Preferably, the clips 610 are attached approximately every 45" off-center horizontally. In the presently preferred embodiment, the clips 610 are designed to receive at least one piece of a 2"×2"×1/4" angled metal 613. For holding lateral panels 601 to 602 and 603 to 604, angled metal is a straight piece of angled metal 614. However, the clips are positioned on panels 602 and 603 near the corner for receiving an "L"-shaped piece, or elbow, of angled metal 615. As will be appreciated, when the metal members 614 and 615 are inserted into the slots 612 of the clips 610 (and in conjunction with metal clips 500 at the seams) the panels 601, 602, 603, and 604 are held in the proper position for the outside to be finished with shotcrete. This configuration serves to hold the panels in alignment and the corners square. Once the shotcrete, or other finishing material has dried, the angled metal and clips are removed and the inside can be finished with shotcrete or other material.

Figure 18:
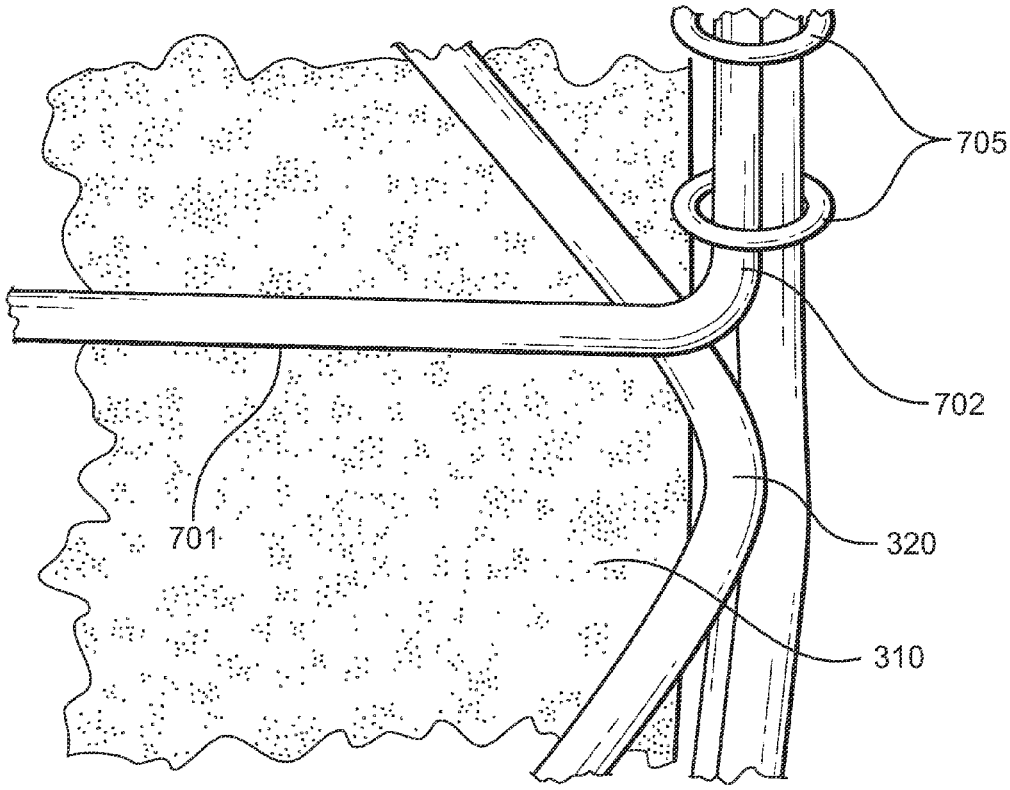
FIG. 18 is a close-up photograph of one end of a Z-clip inserted through two hog rings of a panel according to the invention.
Figure 16:
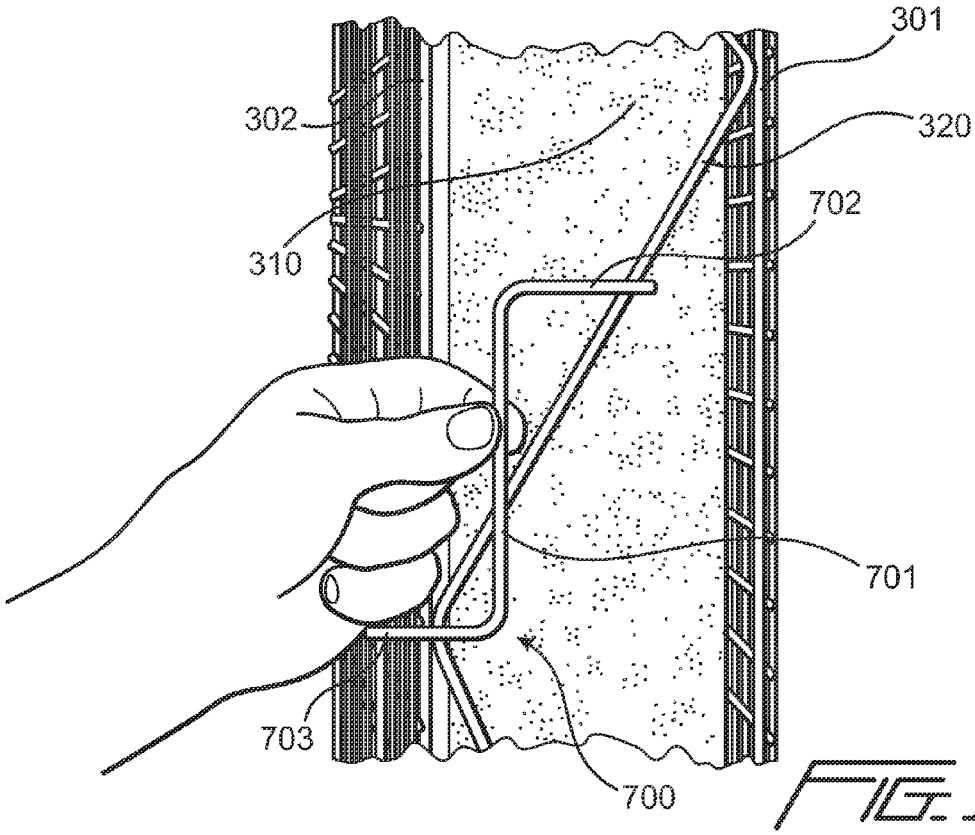
FIG. 16 is a close-up photograph of a Z-clip according to the invention.
Figure 17:
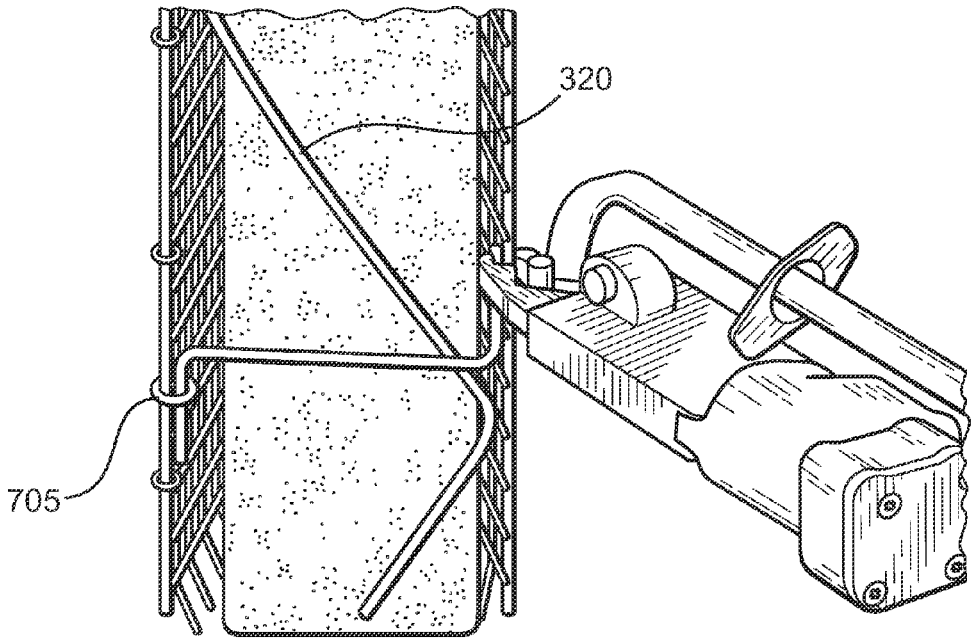
FIG. 17 is a photograph of a Z-clip attached to a panel according to the invention.

FIGS. 16-18 depict yet another tool and method for manufacturing construction panels. To further secure wire mesh members 301 and 302, a "Z-clip" 700 may be used. As best shown in FIG. 16, Z-clip 700 comprises a piece of metal, preferably 3/16" galvanized wire bent into a pseudo-Z shape configuration. The Z-clip has a body section 701 and a pair of parallel, but oppositely oriented arms 702, 703. The Z-clip 700 is sized to attach to each truss while manufacturing the Met-Rock Panel 300. As shown in FIG. 17, the Z-clip's oppositely oriented arms 702, 703 are inserted through hog rings 705 disposed on each truss. As shown in FIG. 18, it is presently preferred to have the oppositely oriented arms traverse two hog rings 705. The Z-clip is particularly recommended when the panels are used for roof and floor panels, as well as when used as a retaining wall or for cistern or pools and the like where ground or water pressure is a concern.

Those skilled in the art will appreciate that various adaptations and modifications of the above-described preferred embodiments can be configured without departing from the scope and spirit of the invention. Therefore, it is to be understood that, within the scope of the appended claims, the invention may be practiced other than as specifically described herein.

We claim:

1. A construction panel comprising:

an outer wire mesh member and an inner wire mesh member; each of said wire mesh members defining at least two outwardly projecting screed ridges extending parallel to one another a length of said wire mesh members;

a middle member comprising a plurality of layers comprising wire trusses and polystryene disposed between said outer and inner mesh members and positioned to define a first gap between said middle member and said outer mesh member and a second gap between said middle member and said inner mesh member, said middle member being connected to said inner and outer mesh members by attaching said mesh members to trusses on outside ends of said middle member and wherein when attached the orientation of respective apexes of the screed ridges on said inner and outer members are diametrically opposed such that the apexes of the screed ridges on said inner member extend away from said middle member in a first direction and the apexes of the screed ridges on said outer member extend away from said middle member in a second direction, said second direction being the opposite direction of the first direction; and first and second outer layers of concrete material applied to said inner and outer mesh members to a depth extending from said middle member to the apexes of said inner and outer mesh members.

2. The construction panel of claim 1, wherein said screed ridges extend the entire length of said wire mesh members from a top end to a bottom end.

3. The construction panel of claim 2, wherein said screed ridges are configured as V-shaped impressions in said wire mesh members.

4. The construction panel of claim 3, wherein the apexes of said screed ridges extend about 1/2 inch out of plane with their respective mesh members.

5. The construction panel of claim 4, wherein said wire mesh members are approximately 47.25 inches to 48 inches wide and include two parallel screed ridges positioned approximately 30 inches off center.

6. The construction panel of claim 5, wherein said wire mesh members are approximately 47.25 inches to 48 inches wide and include three parallel screed ridges such that a first screed ridge is positioned at about 24 inches from each side edge of said mesh member, a left ridge at about 8 inches from the left edge of said mesh member, and a right ridge about 8 inches from a right edge of said mesh member.

7. A construction panel comprising:

a pair of wire mesh members sandwiching a middle member comprising polystyrene, each of said wire mesh members defining two outwardly projecting screed ridges extending a length of said wire mesh members, wherein each of said screed ridges are configured as V-shaped impressions having an apex extending about ½ inch and oriented such that the apexes of each wire mesh member extend away from said middle member, and an outer layer of concrete material applied to each of said wire mesh members to a depth extending from said middle member to the apexes of said inner and outer mesh members.

8. The construction panel of claim 7, wherein said middle member comprises a plurality of layers comprising wire trusses and polystyrene and is disposed between said wire mesh members to define a gap between said middle member and each of said wire mesh members.

9. The construction panel of claim 8, wherein said middle member is connected to each wire mesh member by attaching said mesh members to trusses on outside ends of said middle member.

10. The construction panel of claim 9, wherein each of said wire mesh members is approximately 47.25 inches to 48 inches wide and said screed ridges are disposed about 30 inches off-center.

11. A construction panel comprising:

a pair of wire mesh members sandwiching a middle member comprising polystyrene, each of said wire mesh members defining three outwardly projecting screed ridges extending a length of said wire mesh members, wherein each of said screed ridges are configured as V-shaped impressions having an apex extending about ½ inch and oriented such that the apexes of each wire mesh member extend away from said middle member, and an outer layer of concrete material applied to each of said wire mesh members to a depth extending from said middle member to the apexes of said inner and outer mesh members.

12. The construction panel of claim 11, where said middle member comprises a plurality of layers comprising wire trusses and polystyrene and is disposed between said wire mesh members to define a gap between said middle member and each of said wire mesh members.

13. The construction panel of claim 12, wherein said middle member is connected to each wire mesh member by attaching said mesh members to trusses on outside ends of said middle member.

14. The construction panel of claim 13, wherein each of said wire mesh members is approximately 47.25 inches to 48 inches wide and defines three screed ridges including a first screed ridge at about 24 inches and a left ridge at about 8 inches from a left edge of said mesh member and a right ridge about 8 inches from a right edge of said mesh member.

* * * * *